US008561369B2

(12) United States Patent
Insa

(10) Patent No.: US 8,561,369 B2
(45) Date of Patent: Oct. 22, 2013

(54) MOLDING PROFILE AND MOLDING PROFILE ASSEMBLY

(75) Inventor: Jose Francisco Gōmez Insa, Xeresa (ES)

(73) Assignee: Faus Group, Inc., Gandia (Valencia) (ES)

( * ) Notice: Subject to any disclaimer, the term of this patent is extended or adjusted under 35 U.S.C. 154(b) by 0 days.

(21) Appl. No.: 12/759,600

(22) Filed: Apr. 13, 2010

(65) Prior Publication Data

US 2010/0186332 A1 Jul. 29, 2010

Related U.S. Application Data

(60) Division of application No. 11/902,200, filed on Sep. 19, 2007, now Pat. No. 8,240,098, which is a continuation of application No. 10/800,029, filed on Mar. 15, 2004, now Pat. No. 7,287,357.

(51) Int. Cl.

| | |
|---|---|
| ***E04D 1/36*** | (2006.01) |
| ***E04F 15/00*** | (2006.01) |
| ***E04C 2/38*** | (2006.01) |

(52) U.S. Cl.
USPC ..... 52/464; 52/718.01; 52/311.2

(58) Field of Classification Search
USPC ..... 52/459, 462, 464, 466, 468, 471, 716.1, 52/716.6, 717.01, 718.04, 717.03, 717.05
See application file for complete search history.

(56) References Cited

U.S. PATENT DOCUMENTS

| | | | |
|---|---|---|---|
| 1,661,750 | A | 3/1928 | Dunbar |
| 2,108,226 | A | 2/1938 | Johnston |
| 3,373,068 | A | 3/1968 | Grosheim et al. |
| 3,411,977 | A | 11/1968 | Slater, Jr |
| 3,665,666 | A | 5/1972 | Delcroix |
| 3,814,647 | A | 6/1974 | Scher et al. |
| 3,878,030 | A | 4/1975 | Cook |
| 4,062,992 | A | 12/1977 | Power et al. |
| 4,118,533 | A | 10/1978 | Hipchen et al. |
| 4,131,705 | A | 12/1978 | Kubinsky |
| 4,284,453 | A | 8/1981 | Endrizzi |
| 4,290,248 | A | 9/1981 | Kemerer et al. |
| 4,367,110 | A | 1/1983 | Yoshikawa |
| 4,376,812 | A | 3/1983 | West |
| 4,396,448 | A | 8/1983 | Ohta et al. |
| 4,500,373 | A | 2/1985 | Kubota |
| 4,557,779 | A | 12/1985 | Bower et al. |
| 4,585,685 | A | 4/1986 | Forry et al. |
| 4,599,127 | A | 7/1986 | Cannady, Jr. et al. |
| 4,689,102 | A | 8/1987 | Prawdzik et al. |
| 4,864,790 | A | 9/1989 | Liardet |
| 4,894,972 | A | 1/1990 | Endoh et al. |
| 4,940,503 | A | 7/1990 | Lindgren et al. |

(Continued)

FOREIGN PATENT DOCUMENTS

| | | |
|---|---|---|
| EP | 0 788 576 B1 | 9/2000 |

*Primary Examiner* — Joshua J Michener
*Assistant Examiner* — Elizabeth A Plummer
(74) *Attorney, Agent, or Firm* — Vedder Price P.C.

(57) ABSTRACT

A molding profile assembly has a first and second molding profile. The first molding profile, whose upper surface is to form the upper surface of the molding profile assembly, has a groove formed into an under-surface of a first arm and a groove formed into a foot perpendicular to the arm. The second molding profile has first and second tabs which fit snugly into the first and second grooves of the first molding profile, respectively, interlocking the first and second molding profiles together. The molding profiles do not require scraping, stripping or other permanent alteration in order to be assembled together.

19 Claims, 4 Drawing Sheets

(56) References Cited

U.S. PATENT DOCUMENTS

| | | | |
|---|---|---|---|
| 5,136,823 | A | 8/1992 | Pellegrino |
| 5,155,952 | A | 10/1992 | Herwegh et al. |
| 5,226,273 | A | 7/1993 | Burke |
| 5,283,102 | A | 2/1994 | Sweet et al. |
| 5,314,554 | A | 5/1994 | Owens |
| 5,335,473 | A | 8/1994 | Chase |
| 5,413,834 | A | 5/1995 | Hunter et al. |
| 5,437,934 | A | 8/1995 | Witt et al. |
| 5,525,394 | A | 6/1996 | Clarke et al. |
| D373,203 | S | 8/1996 | Kornfält et al. |
| 5,570,554 | A | 11/1996 | Searer |
| 5,681,428 | A | 10/1997 | Nakajima et al. |
| 5,713,173 | A | 2/1998 | Von Langsdorff et al. |
| 5,723,221 | A | 3/1998 | Brooker et al. |
| 5,736,227 | A | 4/1998 | Sweet et al. |
| 5,744,220 | A | 4/1998 | Ringö |
| 5,858,160 | A | 1/1999 | Piacente et al. |
| 5,961,903 | A | 10/1999 | Eby et al. |
| 6,032,425 | A | 3/2000 | Gugliotti et al. |
| 6,101,778 | A | 8/2000 | Mårtensson |
| 6,114,008 | A | 9/2000 | Eby et al. |
| 6,115,975 | A | 9/2000 | Abdollahi |
| 6,146,252 | A | 11/2000 | Mårtensson |
| 6,156,402 | A | 12/2000 | Smith |
| 6,182,410 | B1 | 2/2001 | Pervan |
| 6,224,698 | B1 | 5/2001 | Endo |
| 6,247,285 | B1 | 6/2001 | Moebus |
| 6,375,777 | B1 | 4/2002 | Sjölin et al. |
| 6,401,415 | B1 | 6/2002 | Garcia |
| 6,418,683 | B1 | 7/2002 | Martensson et al. |
| 6,421,970 | B1 | 7/2002 | Martensson et al. |
| 6,465,046 | B1 | 10/2002 | Hansson et al. |
| 6,517,935 | B1 | 2/2003 | Kornfält et al. |
| 6,558,754 | B1 | 5/2003 | Velin et al. |
| 6,565,919 | B1 | 5/2003 | Hansson et al. |
| 6,805,951 | B2 | 10/2004 | Kornfält et al. |
| 6,860,074 | B2 | 3/2005 | Stanchfield |
| D504,181 | S | 4/2005 | Stanchfield |
| D504,730 | S | 5/2005 | Kornfält et al. |
| D504,731 | S | 5/2005 | Stanchfield |
| 6,898,911 | B2 | 5/2005 | Kornfalt et al. |
| 7,150,134 | B2 | 12/2006 | Kornfalt et al. |
| 7,207,143 | B2 | 4/2007 | Stanchfield |
| 7,389,613 | B2 | 6/2008 | Sondermann |
| 7,559,177 | B2 | 7/2009 | Stanchfield |
| 2002/0160680 | A1 | 10/2002 | Laurence et al. |
| 2003/0159389 | A1 | 8/2003 | Kornfalt et al. |
| 2006/0150565 | A1 | 7/2006 | Schacht et al. |
| 2006/0201093 | A1 | 9/2006 | Stanchfield |
| 2006/0260241 | A1 | 11/2006 | Stanchfield |

MOLDING PROFILE AND MOLDING PROFILE ASSEMBLY

This application is a Divisional of application Ser. No. 11/902,200 filed Sep. 19, 2007, now U.S. Pat. No. 8,240,098 which is a Continuation of application Ser. No. 10/800,029 filed Mar. 15, 2004, now U.S. Pat. No. 7,287,357 both of which are hereby incorporated by reference in their entireties for all purposes as if fully set forth herein.

BACKGROUND OF THE INVENTION

1. Field of the Invention

The present invention relates to molding profiles and flooring surfaces. Specifically, the present invention relates to molding profiles that are combined to form and molding profile assemblies (or moldings) used to transition from a first flooring surface to a second flooring surface, where the first and second flooring surfaces may be at the same or different height.

2. Discussion of the Related Art

The variety of building surfaces has grown rapidly as a wider variety of materials has become available to make these flooring surfaces. Commercial and residential interiors may contain a number of different building surfaces, each made of a different material. For example, in the case of a building surface such as flooring, a residential interior may contain wall-to-wall carpeting, laminate flooring, hardwood flooring, ceramic tile, stone, or other types of flooring. Because of this, the flooring surfaces may be at different heights from one another. Accordingly, there is a need to provide a transition from one flooring surface to another flooring surface that is both aesthetically pleasing as well as functional. It is also important that these transitions be made at low cost and with a high level of durability. Transition molding profiles are often used to provide this transition from one flooring surface to another.

For example, laminate flooring has become very popular because of its low cost, its versatility and its very high durability. Commensurately, laminate flooring requires transition molding profiles that are equally versatile, low-cost, and durable. In cases where the flooring surfaces include a combination of laminate wood flooring and ceramic tile, stone, hardwood flooring or carpeting, the molding profile must transition smoothly from the laminate wood flooring surface at one height to the other surface which may be at a different height. In addition, the molding profile should be simple to assemble, so that a customer can quickly and easily assemble the molding profiles together. Furthermore, the combined molding profile assembly should be suitable for use with their particular combination of flooring surfaces.

It is understood that molding profile assemblies can be made of two or more molding profiles each of which is made of a laminate of, for example, pressboard, chipboard, pressed paper, particle board, or melamine and having a décor paper and a protective coating. The molding profiles may be attached together with glue or with a glueless locking system to create a variety of molding profile assemblies from a minimum number of separate molding profiles. The molding profile assembly is then installed between the two flooring surfaces by attaching it to the floor via a track or some other means.

While these molding profile assemblies provide a variety of edge contours and transitions, their assembly is complex. Specifically, some molding profile assemblies require that one of the component molding profiles be permanently or irreversibly altered, e.g. by stripping or scraping part of the profile, in order to form a new molding profile component and to assemble the completed molding profile assembly.

However, because transition molding profile assemblies are often be very long, for example on the order of a few to several feet, the irreversible alteration that the installer is required to make to one or more of the molding profile components, such as stripping or scraping, can be painstaking and labor intensive. As such, there is a need for a transition molding profile assembly that is low-cost, highly durable, easy to manufacture and quick to install. There is also a need for a transition molding profile assembly that can be assembled from a small number of component molding profiles, without any permanent or irreversible alteration to any of the component molding profiles. This way the intact molding profiles can be assembled quickly and easily, and, if necessary, disassembled and reassembled to form a different transition molding profile assembly.

SUMMARY OF THE INVENTION

Accordingly, the present invention is directed to molding profiles and molding profile assemblies that substantially obviate one or more of the problems due to limitations and disadvantages of the related art.

The advantages of the present invention is to provide a molding profile assembly which can be assembled from as few as two molding profiles.

Another advantage of the present invention is to provide a molding profile assembly in which the component molding profiles are assembled intact and unaltered.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a molding profile for use between two surfaces is provided having an upper body portion with a first arm and a second arm extending along a transverse axis of the molding profile; a foot projecting from the upper body portion along a vertical axis of the molding profile; a first groove in an undersurface of the first arm and extending into the first arm, the groove running in a direction parallel to a longitudinal axis of the molding profile In another aspect to the present invention, a molding profile assembly for use between floor surfaces has a first molding profile with an upper body portion having a first arm and a second arm extending along a transverse axis of the molding profile; a foot projecting from the upper body portion along a vertical axis of the molding profile; and a first groove in an undersurface of the first arm and extending into the first arm, the groove running in a direction parallel to a longitudinal axis of the molding profile. The molding profile assembly also has a second molding profile with a first tab, wherein the first groove receives the first tab, thereby attaching the first and second molding profile together.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to exemplary embodiments of the present invention, which are illustrated in the accompanying drawings. FIGS. 1-2C illustrate laminate molding profiles according to various aspects of a first embodiment of the present invention. FIGS. 3-4C illustrate laminate molding profiles according to various aspects of a second embodiment of the present invention.

Figure 1A:
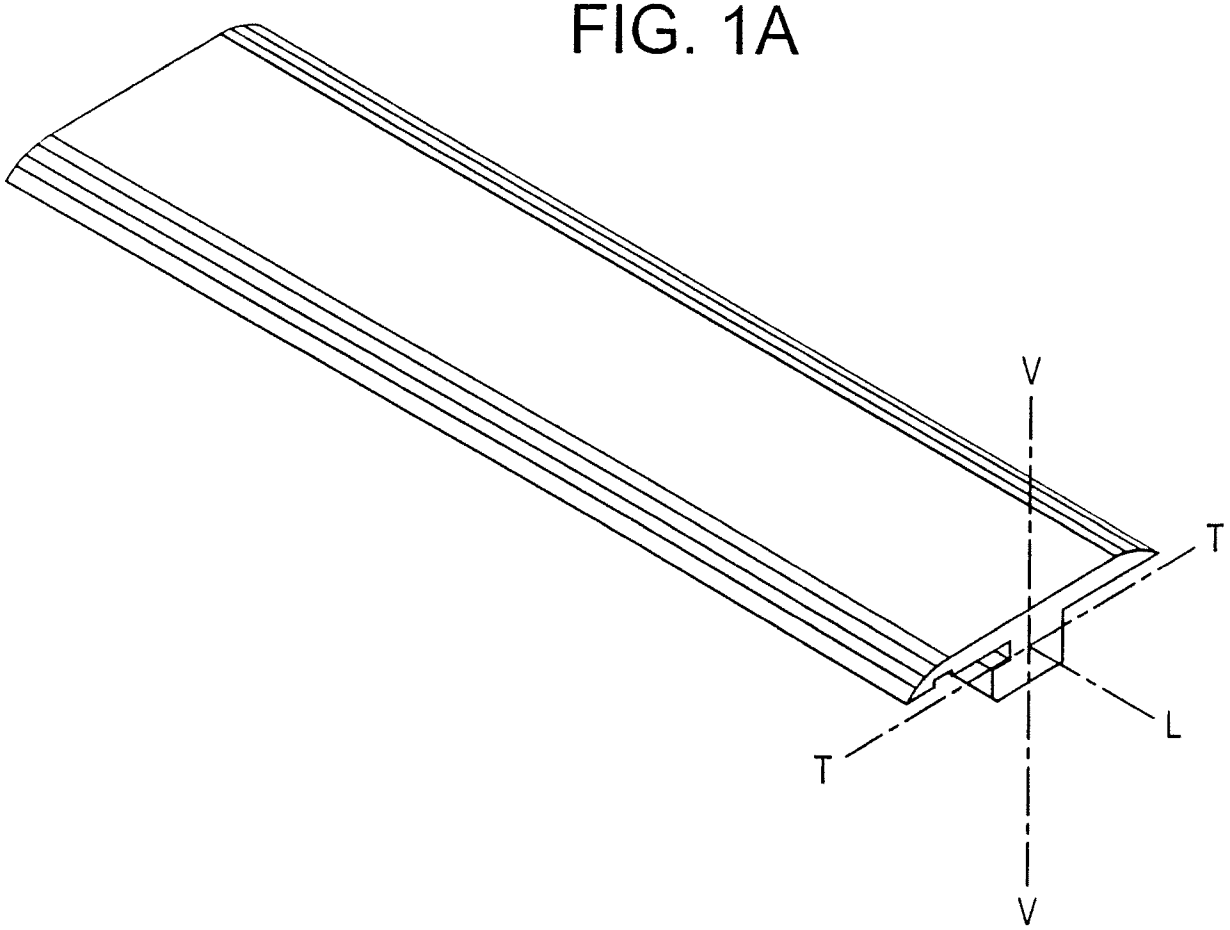
FIG. 1A is a three-dimensional view of a first molding profile according to a first embodiment of the present invention.

FIG. 1A illustrates a three-dimensional view of a first molding profile 10 of the present invention. The first molding profile 10 has a longitudinal axis L, a transverse axis T, and a vertical axis V.

Figure 1B:
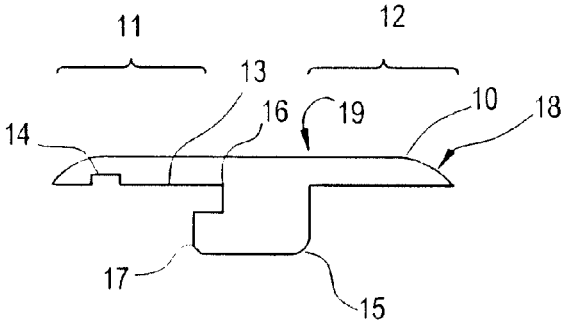
FIG. 1B is a cross-sectional view of a first molding profile according to the first embodiment of the present invention.

FIG. 1B illustrates a cross-section of a first molding profile 10 according to a first exemplary embodiment of the present invention. The first molding profile 10 includes an upper body portion 19 and a foot 15 projecting from the upper body portion 19 in the direction of the vertical axis. The upper body portion 19 has a first arm 11 and a second arm 12 extending parallel to the transverse axis of the first molding profile 10. The first arm 11 has an undersurface 13 in which a first groove 14 is formed. Groove 14 extends into the undersurface 13. The foot 15 extends along the length of the molding profile in the direction of the longitudinal axis. The foot 15 includes a groove 16 formed into a side surface 17 of the foot 15. In this exemplary embodiment, the second groove 16 is formed such that a side surface of the groove 16 is flush, or continuous with, the undersurface 13 of the first arm 11. Other embodiments within the scope of this invention may not have any surface of the groove 16 flush or continuous with the undersurface 13.

Because the first molding profile 10 shown in FIG. 1B has no tabs or other projections extending down from the undersurfaces of the first arm 11 or second arm 12, the first molding profile 10 has the advantage that it may be used intact and alone to transition from one flooring surface to another flooring surface in which both flooring surfaces are at substantially the same height.

In this exemplary embodiment the first groove 14 formed into the first arm 11 may have a width of approximately three millimeters. The second groove 16 formed into the foot 15 may have a width of approximately three millimeters also, and it may also extend into the foot 15 by approximately three millimeters.

Different embodiments having a variety of surface and edge contours are envisioned by the present invention. In this exemplary embodiment of FIG. 1B, the upper body of first molding profile 10 has an upper surface 18 that is substantially flat except near the distal ends of the first and second arms 11 and 12, respectively, which are curved as shown in FIG. 1B.

Figure 1C:
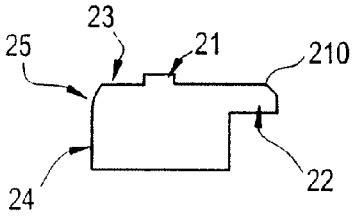
FIG. 1C is a cross-sectional view of a second molding profile according to a first aspect of the first embodiment of the present invention.

FIG. 1C illustrates a second molding profile according to an first exemplary aspect of the first exemplary embodiment of the present invention. The second molding profile 210 is designed to interlock with the first molding profile 10 via the first and second grooves 14 and 16 formed into the undersurface 13 of arm 11 and foot 15 of the first molding profile, respectively. In this aspect of the first exemplary embodiment shown in FIG. 1C, the second molding profile 210 includes a first tab 21 which is received by groove 14 of the first molding profile 10. The second molding profile 210 also includes a protruding second tab 22 which extends outward from and parallel to the upper surface 23 of the second molding profile 20. The second tab 22 is received by the groove 16 of the first molding profile 10. In this embodiment, the tab 21 and the tab 22 of the second molding profile are perpendicular to one another. Furthermore, the second molding profile 210 has an exterior side surface 24 that is substantially perpendicular to the upper surface 18 of the first molding profile 10, where the side surface 24 may include at least one rounded corner 25 designed to continue the rounded edge contour of the upper surface 18 of the first molding profile 10. This way, the upper surface 18 of the first molding profile 10 and the side surface 24 may form a seemingly continuous surface contour. However, the present invention also contemplates different aspects of this exemplary embodiment in which the upper surface 18 and the side surface 24 meet at an edge and do not form a continuous rounded contour or surface.

Figure 1D:
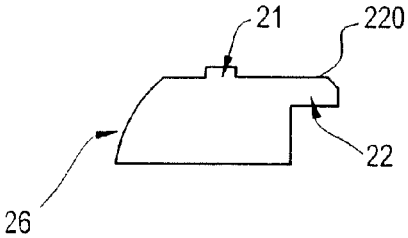
FIG. 1D is a cross-sectional view of a second molding profile according to a second aspect of the first embodiment of the present invention.

FIG. 1D illustrates a second molding profile 220 in accordance with a second exemplary aspect of the first exemplary embodiment of the present invention. Here, the second molding profile 220 has a first tab 21 and a second tab 22 the same as or similar to those illustrated in FIG. 1C. In the aspect of the first exemplary embodiment illustrated in FIG. 1D, the exterior side surface 26 is curved. When the first molding profile 10 and the second molding profile 220 illustrated in FIG. 1D are interlocked, the edge contour from the upper surface 18 of the first molding profile 10 continues substantially uninterrupted along the exterior side surface 26 of the second molding profile 220, forming a continuous curved surface.

Figure 1E:
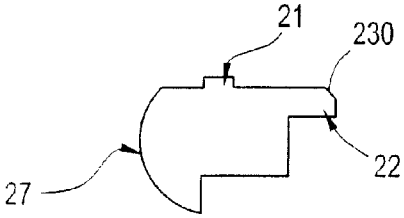
FIG. 1E is a cross-sectional view of a second molding profile according to a third aspect of the first embodiment of the present invention.

In yet a third exemplary aspect of the first exemplary embodiment, illustrated in FIG. 1E, first tab 21 and second tab 22 are the same as or substantially similar to those illustrated in FIGS. 1D and 1C, however, in this aspect of the invention, the exterior side surface 27 has a semicircular shape. When the second molding profile 230, illustrated in FIG. 1E is interlocked with the first molding profile 10, the edge contour formed along the upper surface 18 of the first molding profile 10 extending to the exterior side surface 27 of the second molding profile 230 forms a continuous semicircle.

Figure 2A:
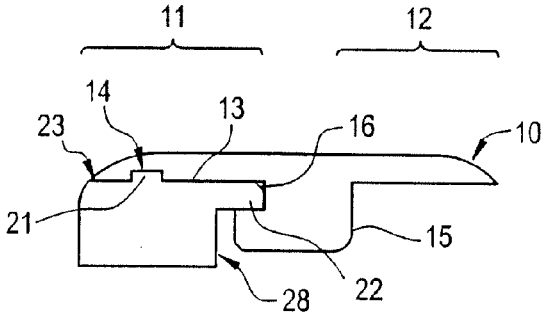
FIG. 2A is a cross-sectional view of the first molding profile interlocked with a second molding profile according to the first aspect of the first embodiment of the present invention.
Figure 2B:
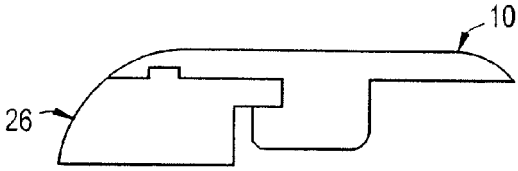
FIG. 2B is a cross-sectional view showing the first molding profile interlocked with a second molding profile according to the second aspect of the first embodiment of the present invention.
Figure 2C:
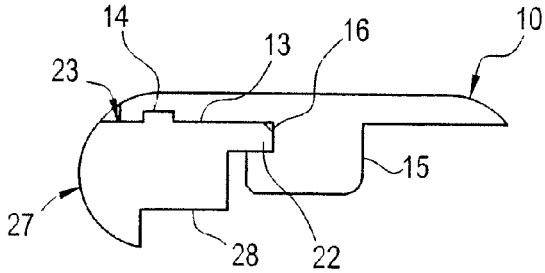
FIG. 2C is a cross-sectional view of the first molding profile interlocked with a second molding profile according to the second aspect of the first embodiment of the present invention.
Figure 3:
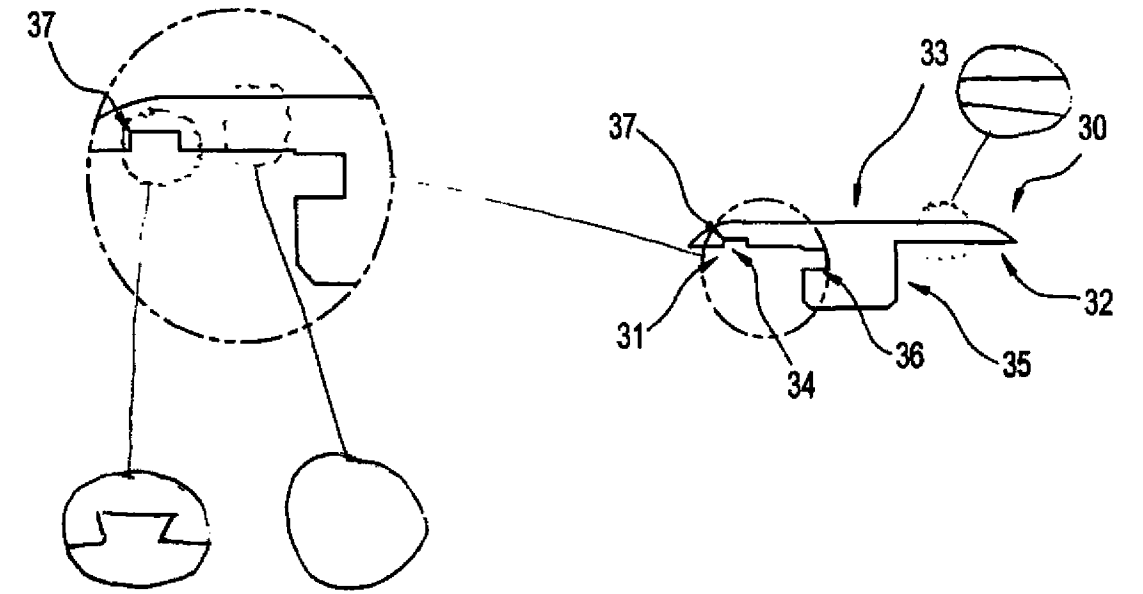
FIG. 3 is a cross-sectional view of a first molding profile according to a second embodiment of the present invention.

FIGS. 2A through 2C illustrate the combined molding profile assemblies resulting when the first molding profile 10 shown in FIG. 1B is interlocked with each of the second molding profiles shown in FIGS. 1C through 1E. In the exemplary embodiment illustrated in FIG. 2A, the second molding profile 210 of FIG. 1C is shown interlocked with the first molding profile 10 of FIG. 1B. Specifically, first groove 14 formed in the under-surface 13 of the first arm 11 of the first molding profile 10 receives the first tab 21 of the second molding profile 20. The second groove 16 of the first molding profile 10 receives the second tab 22 of the second molding profile 210. In this exemplary embodiment, the exterior side surface 24 is substantially perpendicular to the top surface 18 of the first molding profile 10.

In addition, the interior wall 28 of the second molding profile 210 does not contact the foot 15 to facilitate assembly of the two molding profiles 10 and 210 and the installation of complete molding profile assembly in environments where an installation track is used. However, it is understood that the present invention encompasses aspects and embodiments where the interior sidewall 28 of the second molding profile 210 may make contact with the foot 15 of the first molding profile 10 in the complete molding profile assembly.

This type of molding profile assembly may be used to transition from one flooring surface to another flooring surface of the same height, where the two flooring surfaces are made from different materials. For example, it may be used to transition from laminate flooring to a more resilient flooring surface such as carpeting. It may also be used to transition from flooring to a vertical surface of a wall, a bathtub, or cabinetry.

FIG. 2B illustrates an example of a molding profile assembly in which the first molding profile 10 of FIG. 1B is interlocked with the second molding profile 220 illustrated in FIG. 1D. As in FIG. 2A, the first groove 14 and second groove 16 of FIG. 2B receive first tab 21 and second tab 22, respectively. In this exemplary aspect of the invention, the exterior side surface 26 continues the curvature at the rounded edge of the upper surface 18 of the first molding profile 10 to form a continuous rounded surface across both molding profiles. The particular aspect of the invention illustrated in FIG. 2B may be used, for example as a reducer, in which the molding profile assembly is used to transition from a first flooring surface to a second flooring surface which is below the first flooring surface, such as between laminate flooring and ceramic tile.

In the aspect of the first exemplary embodiment illustrated in FIG. 2C, the molding profile assembly is formed by interlocking or otherwise attaching the first molding profile 10 shown in FIG. 1B with the second molding profile 230 illustrated in FIG. 1E. As in the previous aspects of the invention discussed above, the first groove 14 and the second groove 16 receive the first tab 21 and the second tab 22 of the second molding profile 230 respectively. However, the exterior surface 27 of the second molding profile illustrated in FIG. 2C has a semicircular shape such that the edge contour associated with the molding profile assembly is a continuous curve from the upper surface 18 of the first molding profile 10 along the entire exterior surface 27 of the second molding profile 230. In this aspect, the molding profile assembly may be used to provide a rounded finished edge, suitable for use on steps or stairs.

By placing grooves (e.g. grooves 14 and 16) in the first molding profile 10 and tabs (e.g. tabs 21 and 22) in the second molding profile, as illustrated in FIGS. 1C through 1E, different molding profile assemblies may be formed from different combinations of two molding profiles. This is advantageous in that several molding profiles such as the first molding profile 10 and the three variations of the second molding profile 210, 220, and 230 shown in FIGS. 1C through 1E can be shipped together in a single package to provide a finished molding profile assembly for use in a variety of flooring environments to transition from between different flooring surfaces at different or the same heights. Furthermore, the arrangement of grooves associated with a first molding profile surface and tabs associated with a second molding profile surface ensures that the two molding profiles can be assembled intact, without resorting to stripping or altering one of the molding profiles, and, if the need arises the corresponding profile assembly may be disassembled and reassembled later into a different molding profile assembly.

In addition, the present invention contemplates other embodiments and other aspects of the first embodiment in which the dimensions of one or both of the first and second molding profiles may differ from those discussed with reference to FIGS. 1-2C. In fact, the dimensions of one or both of the first and second molding profiles may be chosen to provide particular forces and stresses at the tabs and grooves in order to provide easier installation while still maintaining a tight fit between the molding profiles.

FIG. 3 illustrates a first molding profile 30 according to a second exemplary embodiment of the present invention. In FIG. 3, the first molding profile 30 has a first arm 31, a second arm 32, and an upper surface 33. In this exemplary embodiment, the undersurface of the second arm 32 is formed at an angle relative to the transverse axis and the upper surface 33 of the first molding profile 30, rather than parallel to the transverse axis. In alternative exemplary embodiments, the undersurfaces of both of the first arm 31 and the second arm 32 may be formed at the same or at a different angle relative to the upper surface 33. In the exemplary embodiment illustrated in FIG. 3, the undersurface of the second arm 32 is angled down relative to the transverse axis as the second arm 32. However, other angles are contemplated by the present invention as well.

Forming a portion of the undersurface of one of the arms at an angle relative to the transverse axis of the molding profile allows the molding profile to sit more securely between the adjacent flooring surfaces.

In the second exemplary embodiment illustrated in FIG. 3, a portion of the undersurface near the distal end of second arm 32 may be substantially parallel to the transverse axis and the upper surface 33 of the molding profile 30, while the remainder of the undersurface may not be. Forming some portion of the undersurface at the distal end of the second arm flat or parallel to the transverse axis allows the arm that is not attached to the second molding profile to sit flush against the flooring surface to which it is adjacent. Furthermore, the flat portion allows for more cost effective manufacturing because it allows the machinery used to manufacture the first molding profile to be retooled less frequently than if the slant undersurface were continued to the end of the second arm.

In the exemplary embodiment illustrated in FIG. 3, the undersurface of the first arm 31 has a groove or notch 34 formed therein. This groove 34 runs along the length of the first molding profile 30 in a direction parallel to the longitudinal axis of the molding profile 30. The groove has two side walls connected by a top surface. The side walls may or may not be parallel to each another.

The molding profile 30 also has a foot 35 between the first arm 31 and the second arm 32. The foot 35 has a second groove 36 formed into the side of the foot 35 closest to the first arm 31. The second groove 36 is offset by some vertical distance from the undersurface of first arm 31, so that no surfaces or walls of the second groove 36 are formed flush with the undersurface of the first arm 31. Therefore, in the embodiment illustrated in FIG. 3, the undersurface of the first arm 31 is discontinuous with all of the surfaces or walls of the groove 36.

Forming the second groove 36 in the side of the foot 35 at some distance in the direction of the vertical axis from the undersurface of the first arm 31 allows any of the second molding profiles shown in FIGS. 1 and 2 to be inserted more tightly into the first molding profile 30 shown in FIG. 3.

In the exemplary embodiment illustrated in FIG. 3, the first molding profile 30 may have an overall width of approximately 43 millimeters as measured from the edge of the first arm 31 to the edge of the second arm 32. The height of the first molding profile 30 may be 10.7 millimeters as measured from the bottom of the foot 35 to the top of the upper surface 33. The first arm 31 of the molding profile 30 may have a width of 14.9 millimeters as measured from the edge of the first arm 31 to the foot 35. The second arm 32 may have a width of 16.3 millimeters as measured from the edge of the second arm 32 to the foot 35. The foot 35 may have a width of 12 millimeters.

In addition, the first groove 34 formed into the undersurface of the first a 31 may have a width of 3 millimeters at the undersurface of the first arm 31, however, one side wall 37 of the groove 34 may extend into the interior of the first arm 31 at an angle of 11 degrees so that the top surface width of the first groove 34 may have a width of 3.2 millimeters. In this particular embodiment, the depth of the first groove 34 may be 1 millimeter.

Because the first groove 34 in this particular embodiment has one side wall 37 that is formed at an acute angle relative to the undersurface of the first arm 31 and has a second groove 36 that is formed at some distance below the undersurface of the first arm 31, when the second molding profile slides or snaps into place, the first and second tabs of the molding profiles will fit more securely into the first and second grooves 34 and 36, respectively, of the first molding profile 30.

The second groove 36 formed into the side of the foot 35 closest to the first arm 31 may have a height of 2.5 millimeters and may extend 3 millimeters into the foot 35. In addition, the upper surface of the second groove 36 and the undersurface of the first arm 31 are offset in the direction of the vertical axis by a distance of greater than 0.2 millimeters, for example, thereby forming a stepped configuration. However, in other embodiments, the upper surface of the second groove 36 and the undersurface of the first arm 31 may be offset by an amount that is greater than or less than 0.2 millimeters. The undersurface of the first arm 31, however, is not flush with the upper surface of the groove 36 in this exemplary embodiment.

In addition, in this embodiment, the first groove 34 may be formed into the undersurface of the first arm 31 at a distance of 4.7 millimeters from the distal end of the first arm 31. Furthermore, the foot 35 may have a width of 12 millimeters.

In this particular embodiment, the second arm 32 of the first molding profile 30 may have a thickness of 3.1 millimeters as measured from the undersurface of the second arm 32 at the edge of the first molding profile 30 to the upper surface 33 of the first molding profile 30. However, as noted before, the undersurface of the second arm 32 is formed at an angle relative to the upper surface 33 of the first molding profile 30. In the exemplary embodiment illustrated in FIG. 3, this angle is 2 degrees. Specifically, the thickness of the second arm gradually increases as the second arm 32 extends outward from the foot 35 due to the 2 degree angle. In addition, as noted above, there may be some portion of the undersurface at the distal end of the second arm 32 that is parallel to the upper surface 33. The width of this parallel portion may be 1 millimeter. In a further embodiment, the undersurface of the first arm 31 is formed parallel to the upper surface 33 of the first molding profile 30, but the undersurface of the second arm 32 of the first molding profile 30 is formed at an angle relative to the upper surface 33 of the first molding profile.

Figure 4A:
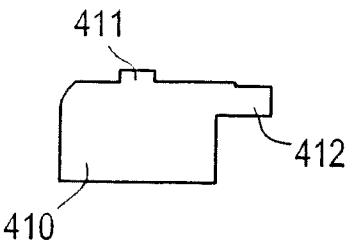
FIG. 4A is a cross-sectional view of a second molding profile according to a first aspect of the second embodiment of the present invention.
Figure 4B:
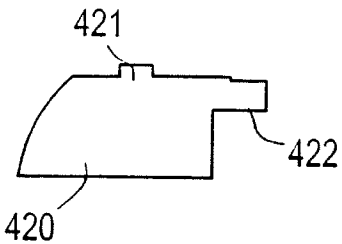
FIG. 4B is a cross-sectional view of a second molding profile according to a second aspect of the second embodiment of the present invention.
Figure 4C:
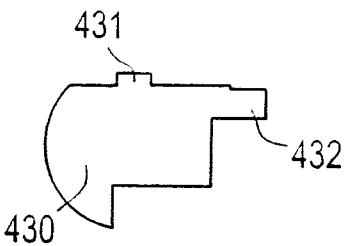
FIG. 4C is a cross-sectional view of a second molding profile according to a third aspect of the second embodiment of the present invention.

FIGS. 4A-4C illustrate second molding profiles according to exemplary aspects of the second exemplary embodiment of the present invention that may be used in conjunction with the first molding profile 30 illustrated in FIG. 3. For example, FIG. 4A illustrates a first exemplary aspect of the second exemplary embodiment in which a second molding profile 410 has a first tab 411 and a second tab 412. Unlike the second molding profile 210 shown in FIG. 1C, the upper surface of the second tab 412 is not flush with the upper surface of the second molding profile 410. Rather, the second tab 412 is located on a side of the molding profile 410 offset at some distance in the direction of the vertical axis below the top surface of the second molding profile 410. This distance corresponds to the distance below the undersurface of the first arm 31 where the second groove 36 of the first molding profile 30 is located.

The second molding profile 410 may be used with the first molding profile 30 illustrated in FIG. 3 to create a molding profile assembly that may be used to transition between flooring surfaces at a similar height but that are made of different materials. For example, the molding profile assembly assembled from the first molding profile 30 and the second molding profile 410 may be used to transition from laminate flooring to carpeting.

FIG. 4B illustrates a second molding profile 420 according to a second exemplary aspect of the second exemplary embodiment. The second molding profile 420 has a first tab 421 and a second tab 422. As stated above in the discussion of the exemplary embodiment illustrated in FIG. 4A, in this aspect of the invention, the upper surface of the second tab 422 is not flush with the upper surface of the second molding profile 420. Rather, the second tab 422 is located on a side of the molding profile 420 offset at some distance in the direction of the vertical axis below the top surface of the second molding profile 420. This distance corresponds to the distance below the undersurface of the first arm 31 where the second groove 36 of the first molding profile 30 is located.

The second molding profile 420 may be used with the first molding profile 30 illustrated in FIG. 3 to create a molding profile assembly that may be used to transition between flooring surfaces at a different heights. For example, the molding profile assembly assembled from the first molding profile 30 and the second molding profile 420 may be used as a reducer to transition from laminate flooring to ceramic tile.

FIG. 4C illustrates a second molding profile 430 according to a third exemplary aspect of the second exemplary embodiment. The second molding profile 430 has a first tab 431 and a second tab 432. As stated above in the discussion of the exemplary aspect of the invention illustrated in FIG. 4A, here, the upper surface of the second tab 432 is not flush with the upper surface of the second molding profile 430. Rather, the second tab 432 is located on a side of the molding profile 430 offset at some distance in the direction of the vertical axis below the top surface of the second molding profile 430. This distance corresponds to the distance below the undersurface of the first arm 31 where the second groove 36 of the first molding profile 30 is located.

The second molding profile 430 may be used with the first molding profile 30 illustrated in FIG. 3 to create a molding profile assembly that may be used to transition between flooring surfaces at a different heights. For example, the molding profile assembly assembled from the first molding profile 30 and the second molding profile 430 may be used with laminate flooring on a step or stairs.

The second molding profiles illustrated in FIGS. 4A-4C may be made to dimensions that correspond to the dimensions of the first molding profile 30 to which the second molding profiles 410, 420 and 430 may be attached. For example, in one exemplary embodiment, the dimensions of the second molding profile may correspond to the dimensions of the first molding profile 30 illustrated in FIG. 3 so that the two molding profiles can be tightly assembled by sliding them together. However, in another exemplary embodiment, the dimensions of the second molding profile may be varied relative to the dimensions of the first molding profile 30 so that the two molding profiles can be snapped together by snapping the tabs into the corresponding grooves.

In addition, the present invention contemplates other aspects and embodiments in which the dimensions of one or both of the first and second molding profiles are chosen to provide different forces and stresses at the tabs and grooves in order to provide easier installation while still maintaining a tight fit between the molding profiles.

While the exemplary aspects and embodiments illustrated the Figures are discussed in relation to laminate flooring, it is understood that the present invention also encompasses embodiments of molding profiles made of other materials such as wood or artificial composites, or that are intended for use with other building surfaces such as wall panels, siding, and ceiling tiles, for example.

It will be apparent to those skilled in the art that various modification and variations can be made in the present invention without departing from the spirit or the scope of the invention. Thus, it is intended that the present invention cover the modifications and variations of this invention provided they come within the scope of the appended claims and their equivalents.

What is claimed is:

1. A molding profile system for use between building surfaces, the molding profile system comprising:

a first molding profile, comprising an upper body portion having a central portion, a first arm and a second arm, the first and second arms each having an undersurface, wherein a thickness of the second arm increases from the central portion of the upper body toward a distal end of the second arm;

a foot projecting from the central portion of the upper body portion; and a first groove extending into the undersurface of the first arm; and a plurality of second molding profiles for forming different molding profile assemblies when combined with the first molding profile, each comprising:

a first tab configured to be received by the first groove wherein the first molding profile further comprises a second groove extending into a side of the foot, wherein an upper edge of the second groove of the first molding profile is offset from the undersurface of the upper body portion of the first molding profile thereby forming a stepped configuration.

2. The molding profile system of claim 1, wherein the first molding profile has no tabs or other projections extending down from the undersurfaces of the first arm or the second arm.

3. The molding profile of claim 1, wherein each second molding profiles further comprises a second tab configured to be received by the second groove.

4. The molding profile system of claim 1, wherein an interior wall adjacent the foot of the first molding profile includes a gap therebetween to facilitate assembly using an installation track.

5. The molding profile system of claim 1, wherein the upper body portion of the first molding profile has an upper surface that is substantially flat except near the distal ends of the first and second arms, respectively, which are curved.

6. The molding profile of claim 5, wherein each second molding profile comprises an exterior side surface, wherein the upper surface of the first molding profile meets the exterior side surface of each second molding profile.

7. The molding profile of claim 6, wherein the exterior side surface of a first of the second molding profiles includes a portion that is substantially perpendicular to the upper surface of the first molding profile.

8. The molding profile of claim 7, wherein the exterior side surface of a second of the second molding profiles continues the curve of the upper surface of the first molding profile and curves outward along the entire exterior side surface.

9. The molding profile of claim 8, wherein the exterior side surface of a third of the second molding profiles continues the curve of the upper surface of the first molding profile and has a substantially semicircular shape.

10. The molding profile of claim 1, wherein the undersurface of the first arm of the first molding profile is at an angle relative to, rather than parallel to, the portion of the upper surface of the upper body that is directly over the foot.

11. The molding profile of claim 1, wherein the undersurface of the second arm of the first molding profile is at an angle relative to, rather than parallel to, the portion of the upper surface of the upper body that is directly over the foot.

12. The molding profile of claim 11, wherein the undersurface of the second arm is angled downwardly.

13. The molding profile of claim 11, wherein a portion of the undersurface of the second arm near a distal end of the second arm is substantially parallel to the upper surface of the upper body that is directly over the foot.

14. The molding profile of claim 1, wherein a width of the first groove of the first molding profile at a top surface of the first groove is greater than a width of the first groove at the undersurface of the first arm.

15. The molding profile of claim 1, wherein the amount of offset is less than a width of the second groove.

16. The molding profile of claim 1, wherein the thickness of the second arm of the first molding profile increases as the second arm extends outward from the foot.

17. The molding profile of claim 1, wherein the thickness of the second arm increases at predetermined angle.

18. The molding profile of claim 17, where in the predetermined angle is 2 degrees.

19. A method of producing a molding profile system, comprising:

forming the first molding profile and the plurality of second molding profiles of claim 1; and providing the first molding profile and the plurality of second molding profiles in a single package.

* * * * *